US007255219B2

(12) United States Patent
Rinke et al.

(10) Patent No.: US 7,255,219 B2
(45) Date of Patent: Aug. 14, 2007

(54) MULTIFUNCTIONAL CONVEYOR DRUM

(75) Inventors: Andreas Rinke, Bad Oldesloe (DE); Matthias Jahnke, Hamburg (DE); Ralf Meyer, Gerdau/Bohlsen (DE); Manfred Dombek, Dassendorf (DE); Johann Elges, Gersthofen (DE); Konrad Popp, Augsburg (DE)

(73) Assignee: Hauni Maschinenbau AG, Hamburg (DE)

( * ) Notice: Subject to any disclaimer, the term of this patent is extended or adjusted under 35 U.S.C. 154(b) by 52 days.

(21) Appl. No.: 10/726,642

(22) Filed: Dec. 4, 2003

(65) Prior Publication Data

US 2004/0108186 A1 Jun. 10, 2004

(30) Foreign Application Priority Data

Dec. 5, 2002 (EP) ..... 02027212

(51) Int. Cl.
*B65G 47/26* (2006.01)

(52) U.S. Cl. ..... 198/458; 198/441; 198/450; 198/456; 131/94; 131/282

(58) Field of Classification Search ..... 198/458, 198/456, 441, 450, 414.1; 131/94, 282; 197/414.1
See application file for complete search history.

(56) References Cited

U.S. PATENT DOCUMENTS 3,142,372 A * 7/1964 Wiese ..... 198/458
4,167,995 A * 9/1979 Schumacher ..... 198/458
4,200,179 A * 4/1980 Hinz ..... 198/458
4,676,360 A * 6/1987 Mattei et al. ..... 198/377.1
4,913,170 A 4/1990 Conti
5,279,406 A * 1/1994 Pawelko et al. ..... 198/458
5,402,802 A 4/1995 Kakiuchi et al.
6,079,545 A * 6/2000 Dombek ..... 198/458

FOREIGN PATENT DOCUMENTS

| | | |
|---|---|---|
| DE | 4134663 | 4/1993 |
| DE | 4242326 | 6/1993 |
| EP | 0577061 | 1/1994 |
| EP | 1138215 | 10/2001 |
| GB | 2262428 | 6/1993 |

* cited by examiner

*Primary Examiner*—Khoi H. Tran
(74) *Attorney, Agent, or Firm*—Greenblum & Bernstein, P.L.C.

(57) ABSTRACT

Conveyor drum for receiving axially aligned articles that are conveyed in a cross-axial direction toward the conveyor drum. Conveyor drum includes a separation device for changing a longitudinal axial spacing of the articles by a predetermined longitudinal axial separation, and an adjustment device structured and arranged to adjust the predetermined longitudinal axial separation. The instant abstract is neither intended to define the invention disclosed in this specification nor intended to limit the scope of the invention in any way.

17 Claims, 4 Drawing Sheets

MULTIFUNCTIONAL CONVEYOR DRUM

CROSS-REFERENCE TO RELATED APPLICATIONS

The present application claims priority under 35 U.S.C. §119 of European Patent Application No. 02 027 212.6, filed on Dec. 5, 2002, the disclosure of which is expressly incorporated by reference herein in its entirety.

BACKGROUND OF THE INVENTION

1. Field of the Invention

The invention relates to a conveyor drum for articles of the tobacco processing industry with a lifting device for changing the longitudinal axial spacing of articles aligned with one another in a longitudinal axial manner and conveyed in at least one row to the conveyor drum in a crosswise axial manner by a predetermined longitudinal axial lift. Furthermore, the invention relates to a machine of the tobacco processing industry.

In the present context, articles of the tobacco processing industry means those objects that are held on conveyors in a single-layer or multi-layer row by vacuum intake air, as, e.g., on conveyor drums in filter or cigarette manufacturing machines and conveyed by the same. Such articles are filter cigarettes, cigars, cigarillos and filter plugs, filter segments, etc. When for the sake of simplicity reference is made below merely to cigarettes or filters, these terms also apply analogously to other articles of the above-mentioned type to be conveyed, e.g., filter segments.

2. Discussion of Background Information

In cigarette machines, cigarettes are kept on conveyor drums crosswise to their longitudinal axial alignment by vacuum intake air. These drums are primarily drums of cigarette manufacturing machines or of filter tipping machines. Cigarettes can be arranged on the conveyor drum next to one another in two essentially parallel rows and moved on the conveyor drum at right angles with respect to the cigarette axes. In order, e.g., to insert a double filter between two cigarettes aligned axially to one another, cut double-length tobacco rods are spread on the conveyor drum in a longitudinal axial manner and a double-length filter plug is inserted.

During the spreading of the cut tobacco rods on the conveyor drum, the cut tobacco rods are subjected to a predetermined lift, so that the cut tobacco rods are spaced in a longitudinal axial manner.

Moreover, sliding drums are known in which filter plugs arranged in parallel rows, displaced relative to one another are pushed together on the sliding drum to form one row of filter plugs arranged one behind the other.

With the known spreading drums and sliding drums, the articles on these conveyor drums are subjected to a predetermined longitudinal axial lift. Due to the construction of the conveyor drums, the lift or the longitudinal axial displacement is fixed. For example, DE-A-41 34 663 describes a device for the axial displacement of a row of cigarettes relative to a parallel row of cigarettes passing through. The seats for the row of cigarettes to be displaced are arranged at the ends of cranked crank arms that are supported in a parallel disk drive. The axes of the parallel disk drive are inclined relative to axes of a drum conveying a row of cigarettes passing through.

SUMMARY OF THE INVENTION

On the basis of this prior art, the present invention provides a conveyor drum that can be easily adapted to articles of the tobacco processing industry of differing lengths, e.g., after a production change, whereby other existing installations of a machine of the tobacco processing industry continue to be used after the production change.

According to the invention, the conveyor drum for articles of the tobacco processing industry with a lifting device for changing the longitudinal axial spacing or movement of articles aligned with one another in a longitudinal axial manner and conveyed in at least one row to the conveyor drum in a crosswise axial manner by a predetermined longitudinal axial lift. Further, the lift (or stroke) of the lifting device is adjustable. The invention is based on the concept that the longitudinal axial lift of an article on the conveyor drum according to the invention can be changed, so that the machine of the tobacco processing industry can be easily adapted to different production conditions for the articles. Thus, an advantageous flexibility is achieved with respect to the articles or formats to be produced. Through the adjustable or adaptable lifting device, the longitudinal axial lift of the articles is individually adjusted on a spreading drum or a sliding drum. By the adjustable lift, a broad palette of formats can be conveyed on the conveyor drum. The adjustability according to the invention of the lifting device relates both to the size or magnitude of the lift, i.e., the length, as well as to the end positions of the lift. With simultaneous rotation of the conveyor drum, the reversal points of the executed longitudinal axial lifting device can be selected or changed as desired. Thus, it is possible, with the same conveyor drum, for lifts of different lengths according to the articles to be conveyed to be executed and/or articles to be taken up or transferred at various transfer points in the longitudinal axial direction.

The potential applications for the conveyor drum are expanded in that a lifting device is provided for each fed row of articles, whereby the respective lifting device is adjustable according to the invention. Thus, on the conveyor drum, the articles of different rows are provided with a longitudinal axial displacement according to requirements.

In a further development of the invention, the lifting device is embodied or formed by at least one wobble plate. The wobble plate is arranged to guide the article seats for the articles inside the drum.

In order to change the separation due to the wobble plate, the wobble plate is advantageously displaceable.

It is particularly advantageous if the wobble plate is displaceable in a longitudinal axial manner parallel to the articles.

The lift or the longitudinal axial displacement of the articles on the conveyor drum is adjustable if the angle between the rotational axis of the wobble plate and the rotational axis of the conveyor drum is changeable.

Individual axial displacements of parallel rows on the conveyor drum are realized if the angle between the rotational axis of the wobble plate and the rotational axis of the conveyor drum is changeable for each wobble plate.

Moreover, for the movement of the conveyor drum or the wobble plates in the conveyor drum a drive is provided for at least one wobble plate. The drive displaces the wobble plate on the control ring of the conveyor drum so that the articles on the conveyor drum are transported from a feed drum to a discharge drum between different longitudinal axial lift end positions with a constant lift.

In particular, at least one adjustment device is provided for the wobble plate, so that the longitudinal axial lift or the longitudinal axial displacement is exactly determined.

To execute an exactly adjusted lift, longitudinal axially moveable seats are provided for the articles on the conveyor drum.

In an alternative, at least two seats are arranged for the articles on a carriage that can be moved axially lengthwise, so that several articles are received in the seats of a carriage and transported on the conveyor drum at the same time. In particular, the carriage has proved effective with sliding drums, since teeth or recesses are embodied on the carriage such that two carriages can be pushed together in a manner complementary in form and function so that two parallel rows with articles arranged in a longitudinal axially displaced manner are pushed to form a single row on the sliding drum with articles lying one behind the other.

To execute the lift or the longitudinal axial displacement, the seats or the carriage are connected to a wobble plate.

In a preferred further development of the invention it is proposed that the seats or the carriage be connected to the wobble plate by a ball joint.

Moreover, the conveyor drum is advantageously embodied or formed as a spreading drum. In an alternative, the conveyor drum is embodied or formed as sliding drum.

The instant invention provides a machine of the tobacco processing industry which includes at least one conveyor drum according to the invention, as described above. The use of the conveyor drum is particularly suitable in cigarette manufacturing machines or filter manufacturing machines, since in these machines spreading drums and/or sliding drums are preferably present.

The present invention is directed to a conveyor drum for receiving axially aligned articles that are conveyed in a cross-axial direction toward the conveyor drum. The conveyor drum includes a lifting device for changing a longitudinal axial spacing of the articles by a predetermined longitudinal axial lift, and an adjustment device structured and arranged to adjust the predetermined longitudinal axial lift.

According to a feature of the instant invention, the conveyor drum can be structured and arranged in a tobacco processing apparatus.

In accordance with another feature of the invention, a lifting device can be positioned to act on each fed row of articles.

Moreover, the lifting device can include at least one wobble plate. The wobble plate may be structured to be displaceable. In particular, the wobble plate can be displaceable in a longitudinal axial manner parallel to the articles and/or the wobble plate can be angularly displaceable, such that an angle between a rotational axis of the wobble plate and a rotational axis of the conveyor drum is changeable. The at least one wobble plate may include a plurality of wobble plates, and, for each wobble plate, the angle between a rotational axis of each wobble plate and the rotational axis of the conveyor drum can be changeable. Still further, a drive is provided for the at least one wobble plate.

According to still another feature of the invention, the adjustment device may be assigned to the at least one wobble plate.

Further, seats can be structured and arranged to move in the longitudinal axial direction.

In accordance with the invention, at least two seats may be arranged for articles on a moveable carriage. The at least two seats or the carriage can be connected to a wobble plate. The at least two seats or the carriage can be connected to the wobble plate by a ball joint.

According to the invention, the conveyor drum can be structured as a spreading drum.

Further, the conveyor drum can be formed as a sliding drum.

The present invention is directed to a machine of the tobacco processing industry that includes at least one conveyor drum, as described above.

The present invention is directed to a process of changing axial spacing between axially aligned articles moving in a cross-axial direction. The process includes placing the articles on positionably adjustable seats, changing a spacing between the positionably adjustable seats within a predetermined range, and adjusting the predetermined range, whereby the spacing between the positionably adjustable seats is changed to the adjusted predetermined range.

In accordance with a feature of the invention, the process can be performed by a conveyor drum. Further, the adjusting of the predetermined range can include changing the position of at least one wobble plate located within the conveyor drum. Moreover, the changing of the position of at least one wobble plate may include adjusting a longitudinal position of the at least one wobble plate within the conveyor drum and/or may include adjusting an angular position of the at least one wobble plate within the conveyor drum.

The present invention is directed to an apparatus to perform the above-described process. The apparatus includes a plurality of aligned positionably adjustable seats, a lifting device coupled to the plurality of aligned positionably adjustable seats, and an adjustment device coupled to the lifting device.

In accordance with still yet another feature of the present invention, the lifting device may include at least one wobble plate to which the plurality of aligned positionably adjustable seats are coupled, and the adjustment device can be coupled to displace the at least one wobble plate. The adjustment device may be structured and arranged to displace the at least one wobble plate at least one of linearly and angularly.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
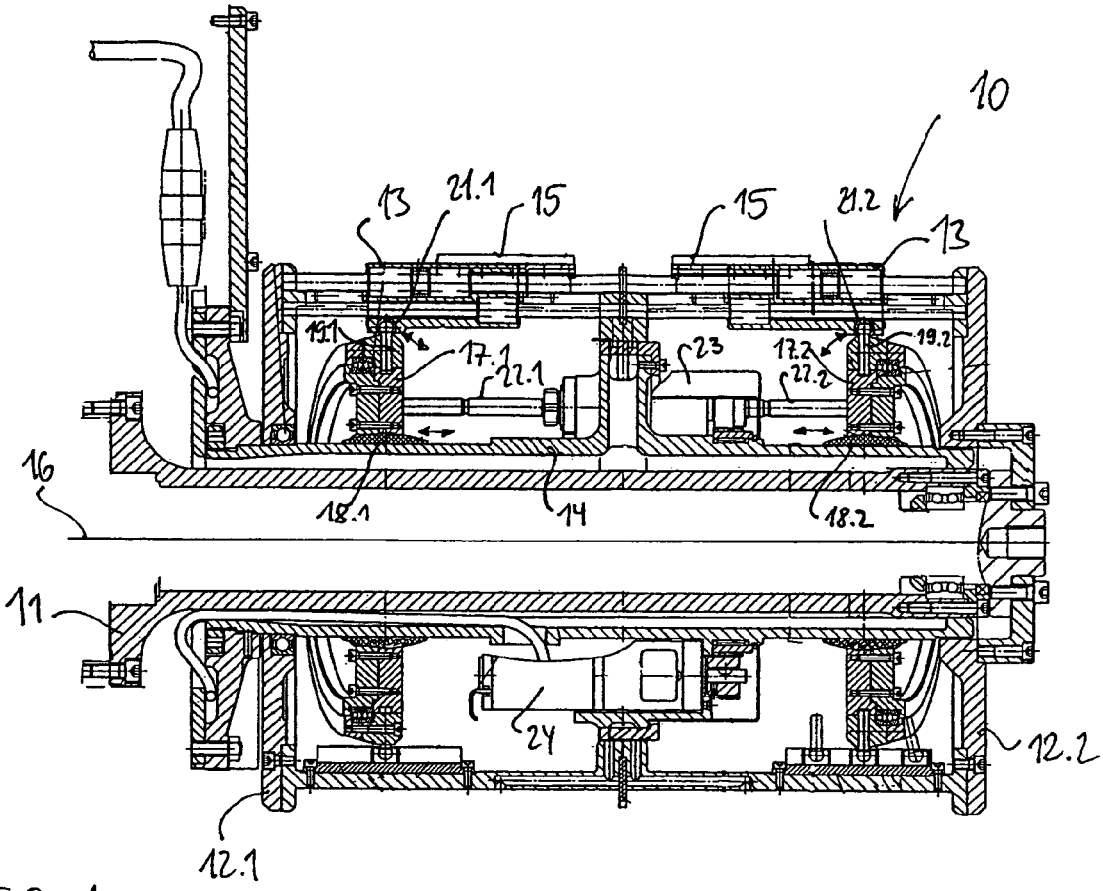
FIG. 1 illustrates a cross sectional view through a spreading drum according to the features of the instant invention.

FIG. 1 shows a cross section through a spreading drum 10 according to the invention. Spreading drum 10 is arranged on a control flange 11 attached, e.g., on the machine side. Spreading drum 10 features drum covers 12.1 and 12.2 on both sides. Seats 13, which are displaceable in a longitudinal axial manner are embodied or formed on the circumferential surface of spreading drum 10. Seats 13 convey cigarettes 15 fed from a feed drum (not shown here) to a discharge drum (also not shown). During the transport from the feed drum to the discharge drum, the longitudinal axial spacing between each pair of cigarettes respectively can be changed, e.g., enlarged. Control flange 11 is surrounded by a control ring 14 around which drum 10 is rotated. The rotational axis of spreading drum 10 is provided with reference number 16.

Wobble plates 17.1 and 17.2 are embodied or formed inside conveyor drum 10 between control ring 14 and seats 13. Wobble plates 17.1 and 17.2 are supported in a pivotable manner on spherical bushings (spherical liners) 18.1 and 18.2 that are supported in a sliding manner on control ring 14. Spherical bushings 18.1 and 18.2 embodied in a ring-like manner are displaceable along the outside surface of the control ring 14.

To connect wobble plates 17.1 and 17.2 to seats 13, ball joints 19.1 and 19.2 are embodied or formed on the outside of wobble plates 17.1 and 17.2 in order to engage bush heads 21.1 and 21.2 of seats 13.

Due to the spherical surface of spherical bushings 18.1 and 18.2, the inclination of wobble plates 17.1 and 17.2 and, thus, their rotational axes with respect to rotational axis 16 of spreading drum 10, is adjusted and/or changed by a predetermined angle. In the example shown (FIG. 1), the rotational axes of wobble plates 17.1 and 17.2 are collinear to rotational axis 16 of spreading drum 10, so that with this specific exemplary arrangement of spreading drum 10 there is no spreading of fed cigarettes 15. This is a special case in the use of spreading drum 10, since the lift (or stroke) has a length of zero. With this adjustment of drum 10, drum 10 is used as a normal conveyor drum without axially spreading or displacing the cigarettes.

To adjust linear positions of wobble plates 17.1 and 17.2 along rotational axis 16 and/or to adjust a predetermined angle between rotational axis 16 of spreading drum 10 and the rotational axes of wobble plates 17.1 and 17.2, an adjusting device is embodied or formed in the interior of spreading drum 10. Wobble plate 17.1 is connected to an adjusting motor 23 via a spindle 22.1, and wobble plate 17.2 is connected to adjusting motor 23 via a spindle 22.2. By rotating spindles 22.1 and 22.2, which have an oppositely directed pitch, the inclination of wobble plates 17.1 and 17.2 is adjusted.

In order to displace wobble plates 17.1 and 17.2 along control ring 14 or to displace the rotational axes of wobble plates 17.1 and 17.2 relative to rotational axis 16 of spreading drum 10, it is advantageous that the adjusting device includes adjusting elements present at at least three places on wobble plates 17.1 and 17.2, e.g., uniformly over the circumference of wobble plates 17.1 and 17.2. Through this type of "three-point suspension," a linear, longitudinal axial lift of wobble plates 17.1 and 17.2 along rotational axis 16 or control ring 14 can occur. Alternatively, or additionally, an angular displacement of the rotational axes of at least one of wobble plates 17.1 and 17.2 relative to rotational axis 16 can occur.

To drive wobble plates 17.1 and 17.2 or drum 10, furthermore a brake 24 is embodied or formed in the interior, which is provided to cause a rapid stop of the rotation of spreading drum 10 by an engaging gear wheel on control ring 14.

For one skilled in the art it is self-evident that the cigarettes are held in or on seats 13 via corresponding vacuum guides or openings.

Figure 2:
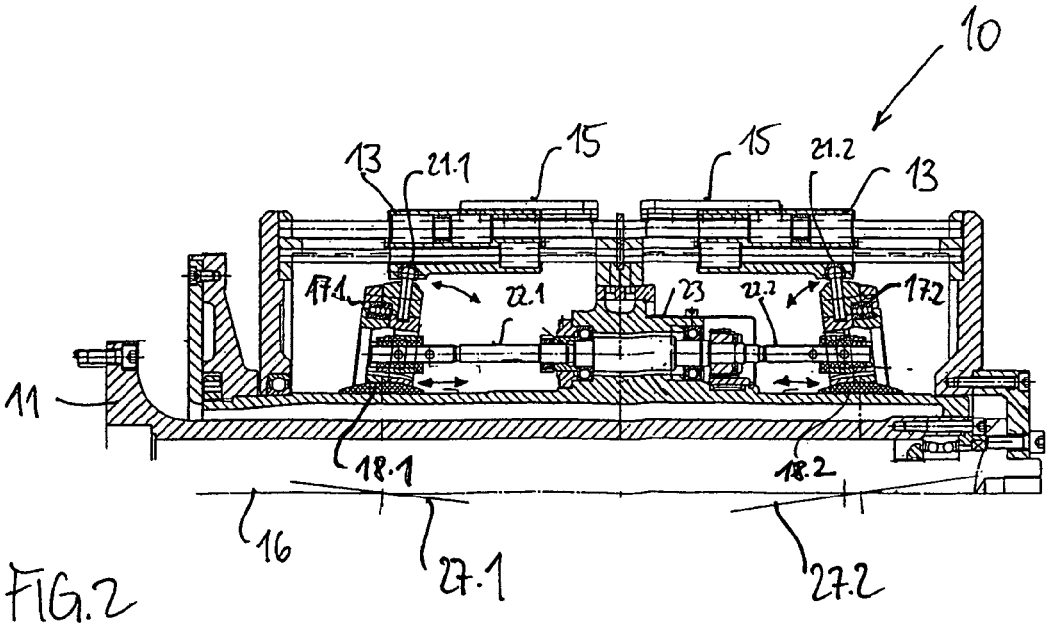
FIG. 2 illustrates a cross sectional view through another conveyor drum.

FIG. 2 shows in cross section a view of a spreading drum 10 in sections. In this cross-sectional view in particular a section through adjusting motor 23 is shown which, in interaction with driven spindles 22.1 and 22.2 that engage in wobble plates 17.1 and 17.2, causes the rotational axes 27.1 and 27.2 of wobble plates 17.1 and 17.2 to be inclined relative to rotational axis 16 of spreading drum 10. Through this adjustment, wobble plates 17.1 and 17.2 are rotated about spherical bushings 18.1 and 18.2. Upper seats 13 shown here move towards one another on spreading drum 10 so that a minimal longitudinal axial spacing is achieved between cigarettes 15 on seats 13. This minimal longitudinal axial spacing between cigarettes 15 corresponds to the spacing of the cigarettes that they have, e.g., on the feed drum during the transfer of the cigarettes from the feed drum to spreading drum 10.

Due to the rotation of spreading drum 10, the cigarettes arranged parallel to one another are moved apart in a longitudinal axial manner and transferred to another drum at a transfer point. Through the adjustable inclination of the wobble plates with respect to horizontal rotational axis 16, the reversal points or the end positions of the longitudinal axial lift of the cigarettes on spreading drum 10 are adjusted. Overall, a quick adjustment of spreading drum 10 to the production process of cigarettes or filters results that is flexible in terms of format and format-dependent. As shown in FIG. 2, wobble plates 17.1 and 17.2 are arranged in a mirror symmetrical manner to one another, since both spindles are rotated simultaneously and symmetrically to one another by adjusting motor 23.

Figure 3:
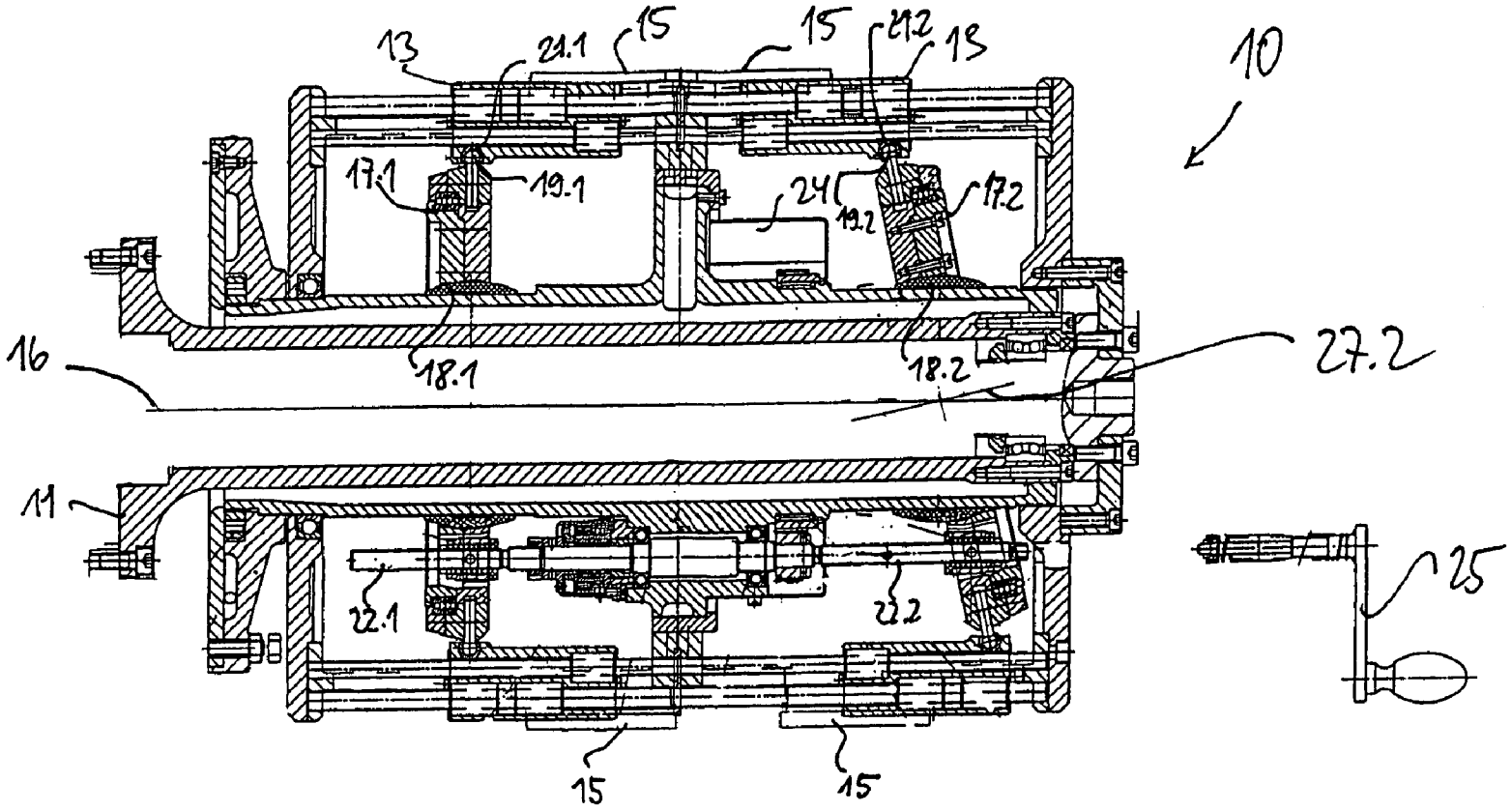
FIG. 3 illustrates a cross-sectional view of a spreading drum.

In FIG. 3 another alternative embodiment of a spreading drum 10 is shown in cross section.

Whereas left wobble plate 17.1 is adjusted so that the seat connected to it does not carry out a lift, right wobble plate 17.2 is adjusted so that cigarette 15 moved by wobble plate 17.2 is subjected to a longitudinal axial displacement, such that cigarettes 15 are spaced apart axially at the transfer point. To adjust wobble plates 17.2, a crank 25 is fixed to spindle 22.2, so that the inclination and the position of wobble plate 17.2, and its rotational axis 27.2, is exactly justified. The manual adjustability of wobble plate 17.2 represents an alternative to the motor-driven adjustment of a wobble plate. Of course, both measures can be combined with one another.

The lifting device according to the invention with an adjustable lift and fixable (longitudinal axial) lift positions with a conveyor drum can be used not only with a spreading drum (FIGS. 1 through 3) but also with a sliding drum, since on a sliding drum the articles to be displaced are likewise subjected to a longitudinal axial displacement towards one another.

Figure 4:
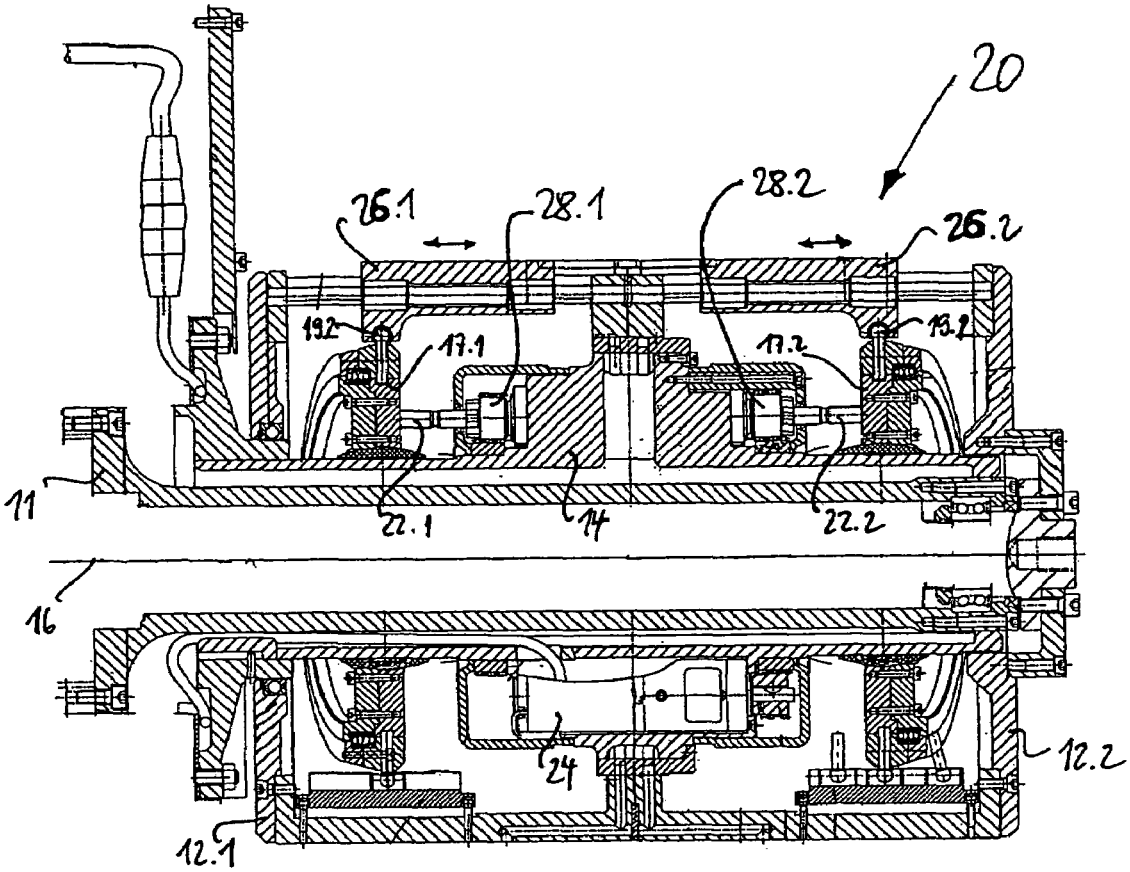
FIG. 4 illustrates a cross-sectional view of a sliding drum.

FIG. 4 shows a cross section through a sliding drum 20. Elements with the same function of spreading drum 10 shown in FIG. 1 are given the same reference numbers in FIG. 4. To accept articles such as, e.g., cigarettes 15, with sliding drum 20, carriages 26.1 and 26.2 are provided on the outer circumference of sliding drum 20 in a lengthwise displaceable manner. Carriages 26.1 and 26.2 have seats for fed articles 15.

In order to adjust the inclination of wobble plates 17.1 and 17.2 individually and independently of one another and to change them, so that carriages 26.1 and 26.2 have different lift reversal points and lifts, an independent adjusting motor 28.1 or 28.2 is assigned to spindles 22.1 or 22.2. In accordance with the article formats to be conveyed the longitudinal axial displacement of carriages 26.1 and 26.2 on control ring 14 can be adjusted here independently of one another via a corresponding control or regulation. Due to the perpendicular arrangement of wobble plates 17.1 and 17.2, carriages 26.1 and 26.2 are not pushed together on sliding drum 20. This is likewise a special case in the use of the sliding drum, since the lifts respectively have the length zero.

Figure 5:
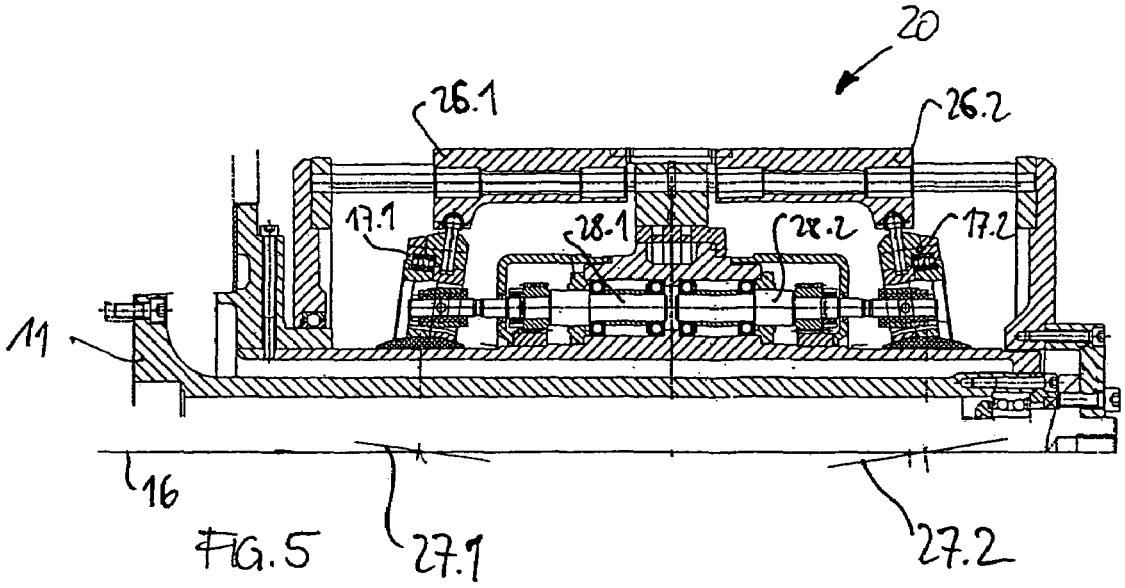
FIG. 5 illustrates a cross sectional view of a sliding drum.

FIG. 5 shows another spreading drum 20 in cross section with which carriages 26.1 and 26.2 are pushed together, i.e., have the lowest longitudinal axial distance from one another. To this end, due to the lift displacement by adjusting motors 28.1 and 28.2, wobble plates 17.1 and 17.2 are arranged crosswise to control ring 14 or to rotational axis 16 of sliding drum 20. In these cases, the rotational axis 27.1 and/or 27.2 of wobble plates 17.1 and/or 17.2 is embodied or arranged inclined by a certain angle to rotational axis 16 of sliding drum 20.

Figure 6:
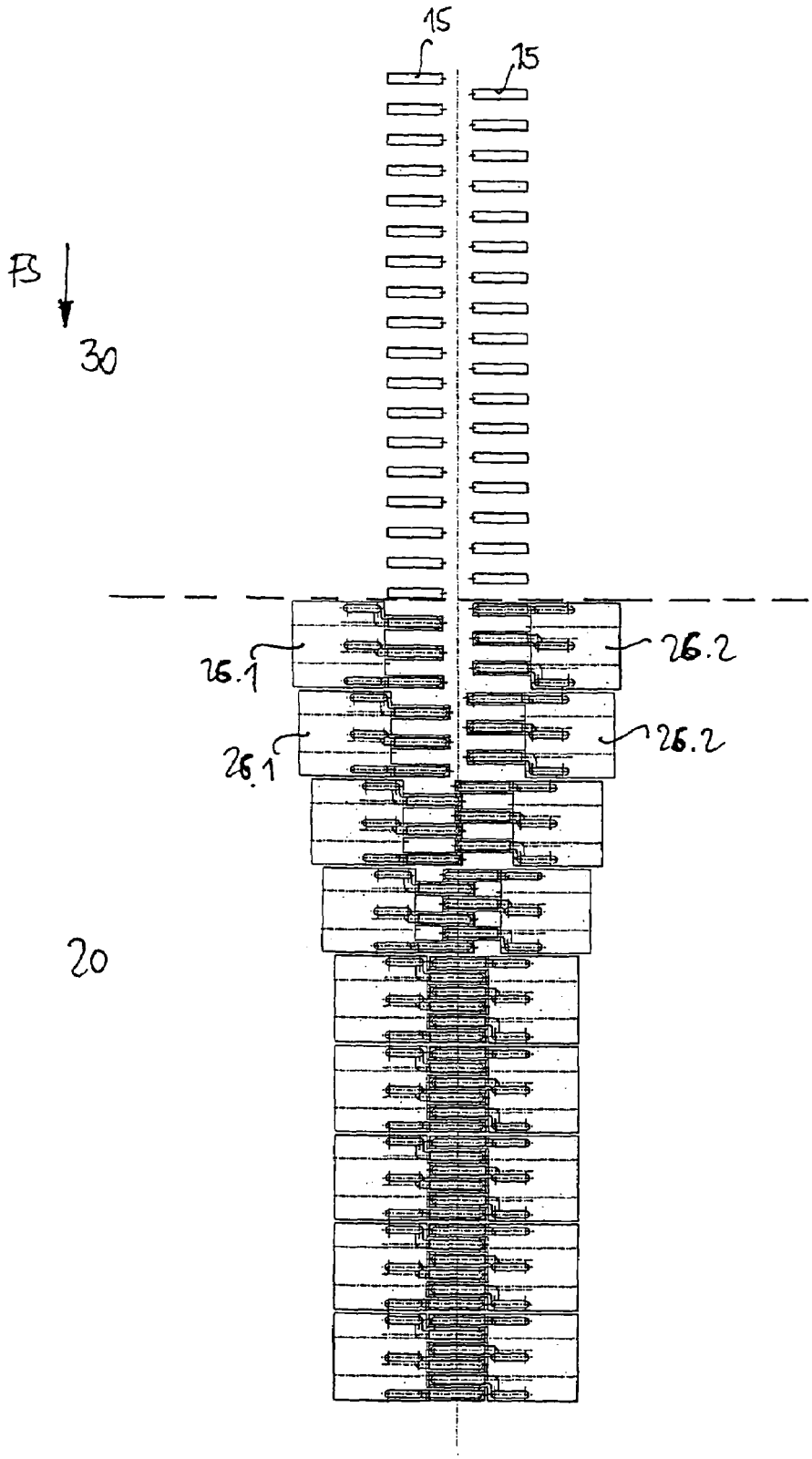
FIG. 6 diagrammatically illustrates the conveying of cigarettes on a sliding drum according to the present invention.

FIG. 6 shows diagrammatically the pushing together of cigarettes 15 that are arranged parallel in two rows and moved or displaced in a longitudinal axial manner to one another. On a feed drum 30, cigarettes 15 are transported next to one another and along conveying track FS. Subsequently, cigarettes 15 are transferred from feed drum 30 to sliding drum 20, whereby the transfer of cigarettes 15 is made to carriages 26.1 and 26.2 embodied with three seats for articles 15.

Subsequently, carriages 26.1 and 26.2 are moved towards one another in a longitudinal axial manner, so that the cigarette rows arranged parallel and displaced with respect to one another are pushed to form one row. Carriages 26.1 and 26.2 feature finger-like seats for cigarettes 15, which seats interlock when carriages 26.1 and 26.2 or the cigarette rows are pushed together. Subsequently the cigarette row pushed together is transferred to a discharging drum. After the transfer of the cigarette row, carriages 26.1 and 26.2 are moved away from one another.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

10 Spreading drum
11 Control flange
12.1 Drum cap
12.2 Drum cap
13 Seats
14 Control ring
15 Cigarettes
16 Rotational axis
17.1 Wobble plate
17.2 Wobble plate
18.1 Spherical bushing
18.2 Spherical bushing
19.1 Ball joint
19.1 Ball joint
20 Sliding drum
21.1 Bush head
21.2 Bush head
22.1 Spindle
22.2 Spindle
23 Adjusting motor
24 Brake
25 Crank
26.1 Carriage
26.2 Carriage
28.1 Adjusting motor
28.2 Adjusting motor
30 Feed drum
FS Conveying track

What is claimed is:

1. A conveyor drum for receiving axially aligned articles that are conveyed in a cross-axial direction toward said conveyor drum, said conveyor drum comprising:

a shifting device for changing a longitudinal axial spacing of the articles by a predetermined longitudinal axial displacement;

an adjustment device structured and arranged to adjust end positions of the predetermined longitudinal axial displacement; and seats structured and arranged to receive the articles and to move in a longitudinal axial direction, wherein said shifting device comprises at least one wobble plate structured to be displaceable, and said wobble plate is angularly displaceable, such that an angle between a rotational axis of said wobble plate and a rotational axis of said conveyor drum is changeable.

2. The conveyor drum in accordance with claim 1, wherein said conveyor drum is structured and arranged in a tobacco processing apparatus.

3. The conveyor drum in accordance with claim 1, wherein said shifting device is positioned to act on each fed row of articles.

4. The conveyor drum in accordance with claim 1, wherein said wobble plate is displaceable in the longitudinal axial direction parallel to the articles.

5. The conveyor drum in accordance with claim 1, wherein said at least one wobble plate comprises a plurality of wobble plates, and, for each wobble plate, the angle between the rotational axis of each wobble plate and the rotational axis of said conveyor drum is changeable.

6. The conveyor drum in accordance with claim 1, further comprising a drive for said at least one wobble plate.

7. The conveyor drum in accordance with claim 1, wherein said adjustment device is assigned to said at least one wobble plate.

8. The conveyor drum in accordance with claim 1, wherein the seats comprise at least two seats arranged for articles on a moveable carriage.

9. The conveyor drum in accordance with claim 8, wherein said at least two seats or said carriage are connected to a wobble plate.

10. A conveyor drum for receiving axially aligned articles that are conveyed in a cross-axial direction toward said conveyor drum comprising:

a lifting device for changing a longitudinal axial spacing of the articles by a predetermined longitudinal axial lift; and an adjustment device structured and arranged to adjust the predetermined longitudinal axial lift, wherein at least two seats are arranged for articles on a moveable carriage, and said at least two seats or said carriage are connected to a wobble plate by a ball joint.

11. The conveyor drum in accordance with claim 1, wherein said conveyor drum is structured as a spreading drum.

12. The conveyor drum in accordance with claim 1, wherein said conveyor drum is formed as a sliding drum.

13. A machine of the tobacco processing industry comprising the at least one conveyor drum in accordance with claim 1.

14. A process of changing longitudinal axial spacing between axially aligned articles moving in a cross-axial direction, comprising:

placing the articles on positionably adjustable seats;

changing the spacing between the positionably adjustable seats within a predetermined range; and adjusting the predetermined range, whereby the spacing between the positionably adjustable seats is changed to an adjusted predetermined range, wherein said process is performed by a conveyor drum, wherein the adjusting of the predetermined range comprises changing a position of at least one wobble plate located within the conveyor drum, and a changing of the position of the at least one wobble plate comprises adjusting an angular position of the at least one wobble plate within the conveyor drum.

15. An apparatus to perform the process of claim 14, said apparatus comprising:

a plurality of aligned positionably adjustable seats;

a shifting device coupled to said plurality of aligned positionably adjustable seats; and an adjustment device coupled to said shifting device.

16. The apparatus in accordance with claim 15, wherein said shifting device comprises at least one wobble plate to which said plurality of aligned positionably adjustable seats are coupled; and wherein said adjustment device is structured and arranged to displace said at least one wobble plate.

17. The apparatus in accordance with claim 16, wherein said adjustment device is structured and arranged to displace said at least one wobble plate at least one of linearly and angularly.

* * * * *